US007147521B2

(12) United States Patent
Molinaro et al.

(10) Patent No.: US 7,147,521 B2
(45) Date of Patent: Dec. 12, 2006

(54) WIRING JUNCTION BLOCK

(75) Inventors: Mark Christopher Molinaro, Fort Wayne, IN (US); John Andrew Forish, Huntertown, IN (US)

(73) Assignee: Federal Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/032,512

(22) Filed: Jan. 10, 2005

(65) Prior Publication Data

US 2005/0181635 A1 Aug. 18, 2005

Related U.S. Application Data

(63) Continuation of application No. 10/447,522, filed on May 29, 2003, now abandoned.

(60) Provisional application No. 60/384,003, filed on May 29, 2002, provisional application No. 60/453,997, filed on Mar. 12, 2003.

(51) Int. Cl.
*H01R 11/09* (2006.01)

(52) U.S. Cl. ..... 439/724; 439/548

(58) Field of Classification Search ..... 439/34–36, 439/721, 723, 724, 548, 907, 221, 222, 224
See application file for complete search history.

(56) References Cited

U.S. PATENT DOCUMENTS

| | | | | |
|---|---|---|---|---|
| 3,263,203 | A * | 7/1966 | Dean et al. | 439/787 |
| 3,421,134 | A * | 1/1969 | Mayo et al. | 439/712 |
| 5,509,819 | A * | 4/1996 | Stein et al. | 439/189 |
| 5,759,064 | A * | 6/1998 | Sugiyama | 439/548 |
| 6,257,938 | B1 * | 7/2001 | Day et al. | 439/723 |
| 2003/0049958 | A1 * | 3/2003 | Bruski et al. | 439/344 |

* cited by examiner

*Primary Examiner*—Ross Gushi

(57) ABSTRACT

A wiring junction block, e.g. for taillamp pigtails in a vehicle lighting system. The wiring junction block includes a body having an input end including a first set of electrical terminals for receiving electrical power from a vehicle wiring harness. The body also has an output end including a second set of electrical terminals for supplying the received electrical power to one or more vehicle lamps. The second set of terminals includes at least one group of two or more terminals that are electrically shorted to each other. The number of terminals in the first set is less than the number of terminals in the second set. A mounting feature is located on the body and is adapted to enable mounting of the body to a vehicle support structure, e.g. apertured panel. The input and output terminals may be electrically connected by stamped circuit traces or a printed circuit board.

1 Claim, 6 Drawing Sheets

FIG. 6
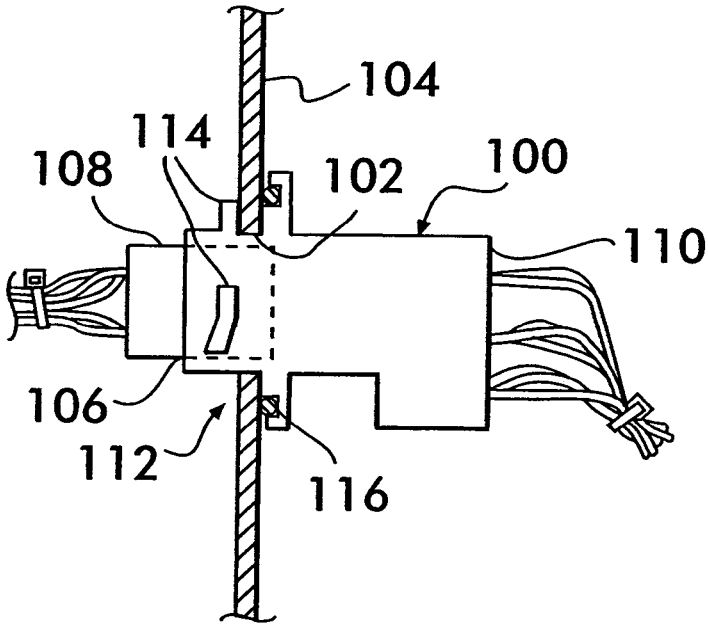
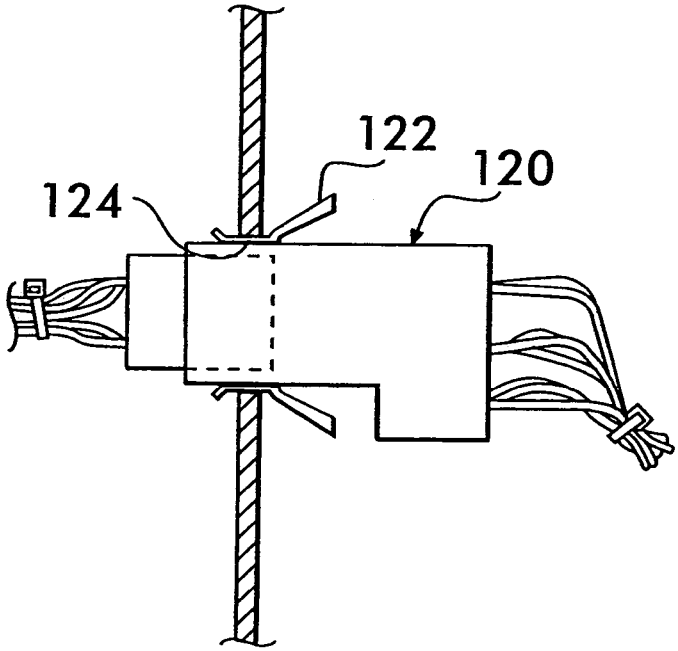
FIG. 7

WIRING JUNCTION BLOCK

FIELD OF THE INVENTION

The present invention relates generally to wiring harnesses and connectors, and more particularly to wiring harnesses and connectors of a type used in automobiles to route electrical power and signals throughout the vehicle.

DISCUSSION OF RELATED ART

A vehicle tail lamp assembly usually includes multiple lighting devices or lamps, and thus requires multiple power and ground wires for its operation. Typically, a vehicle wiring harness connector having multiple outputs directly provides those power and ground signals to the tail lamp assembly. The number of outputs from the wiring harness connector, however, is often times less than the number of inputs required by the multiple lighting devices of the tail lamp assembly. For instance, the wiring harness connector typically has a single ground output, even though that output must provide ground for each of the lighting devices of the assembly. In order to accommodate this unequal number of outputs and inputs, many vehicle lighting systems splice the single ground wire exiting the wiring harness connector into multiple wires, each of which is fed to a different lighting device. Similarly, the wiring harness connector usually provides a single tail lamp output although two or more lamps may be employed on each side of the vehicle to provide the tail lamp function. In order to send a power signal to each of the two tail lamps, that single output is spliced into two separate wires. An example of this type of prior art wiring arrangement is shown in FIG. 1. These splices can complicate assembly, as they may need to be manually installed and often require additional insulation and/or sealing precautions.

SUMMARY

The present invention is directed to an electrical wiring junction block that can be used for various electrical distribution purposes such as, for example, in a vehicle lighting system to connect power from a vehicle wiring harness to one or more vehicle lamps. The wiring junction block includes a body that may be formed of two or more parts. The body has an input end including a first set of electrical terminals for receiving electrical power from a vehicle wiring harness, and an output end including a second set of electrical terminals for supplying the received electrical power to one or more vehicle lamps. The second set of terminals includes at least one group of two or more terminals that are electrically shorted to each other. The number of terminals in the first set is less than the number of terminals in the second set.

In certain embodiments, a mounting feature is located on the body and is adapted to enable mounting of the body to a vehicle support structure, e.g. apertured panel. The input and output terminals may be electrically connected by stamped circuit traces or a printed circuit board.

BRIEF DESCRIPTION OF THE DRAWINGS

The present invention will now be described by way of example with reference to the following drawings in which:

FIG. 6 is a side view of an alternative embodiment of the wiring junction block of FIG. 2;

FIG. 7 is a side view of another alternative embodiment of the wiring junction block of FIG. 2;

DETAILED DESCRIPTION

The present invention is directed to an electrical junction block that can be used for various electrical distribution purposes such as, for example, a vehicle lighting system junction block that is used to connect power from a vehicle wiring harness to one or more vehicle lamps. In this regard, it is noted that the embodiments of the invention discussed below are shown and described for illustrative purposes as they could be used for vehicle exterior lighting, and in particular rear vehicle lighting. However, these embodiments are exemplary only and the invention need not be limited to vehicle exterior lighting applications.

Typically, a vehicle electrical system will include a right rear lighting assembly, a left rear lighting assembly, a center high mount stop lamp, and perhaps other rear vehicle lighting such as one or more lamps for license plate illumination. The right and left rear lighting assemblies can each include brake, turn, tail, and backup illumination, and these four lighting functions are typically provided using at least two separate lamps in each assembly. The illustrated exemplary embodiments are directed to the use of the invention in conjunction with one such rear lighting assembly providing these four lighting functions. Separate junction blocks can be used for the other rear lighting functions, or all of the rear lighting wiring can be passed through a single junction block, as desired for a particular application.

Figure 1:
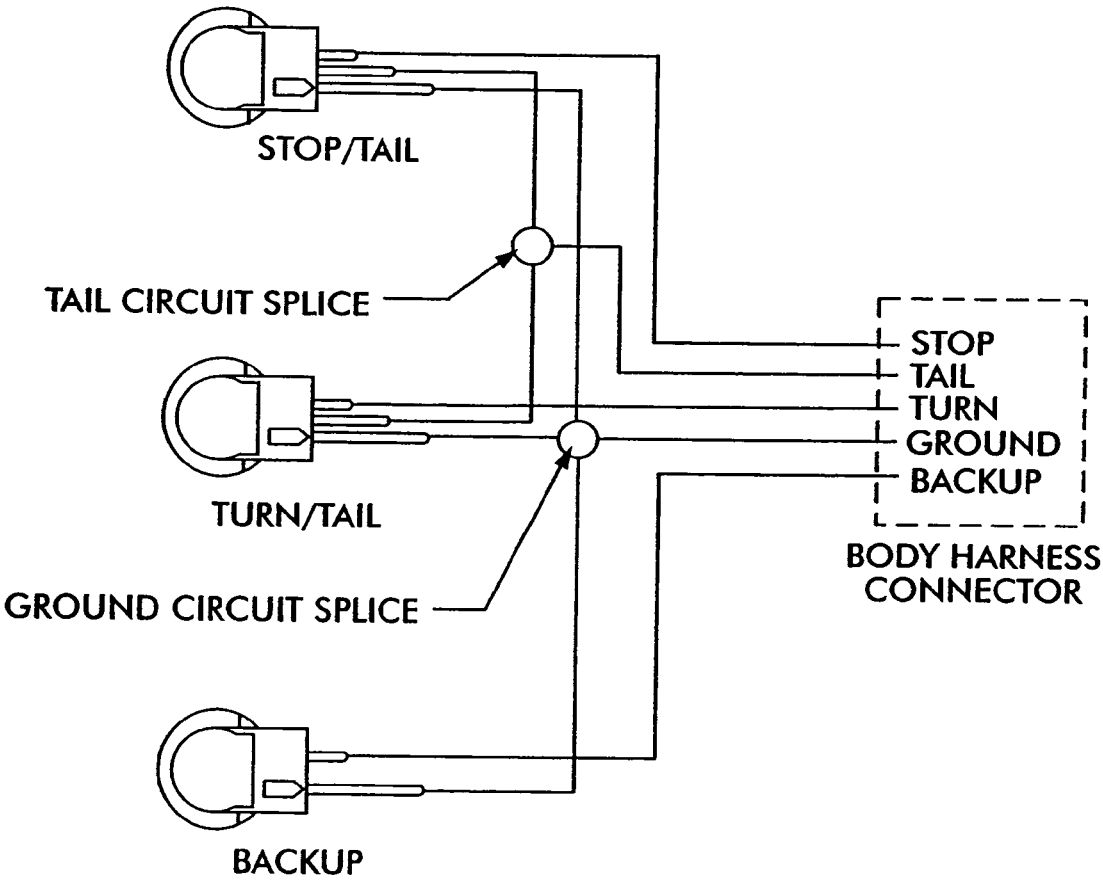
FIG.1 Prior Art
FIG. 1 is a wiring diagram exemplary of the prior art, showing wiring circuit splices.
Figure 2:
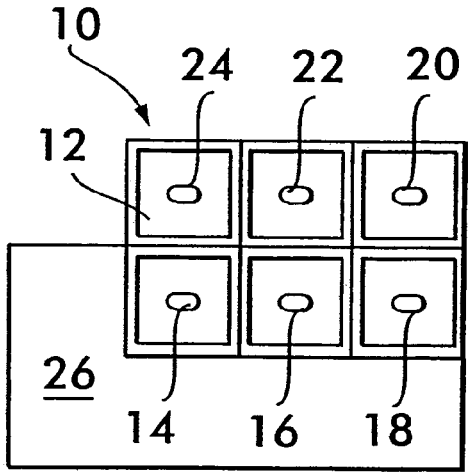
FIG. 2 is a front view of an exemplary electrical wiring junction block in accordance with the present invention.
Figure 3:
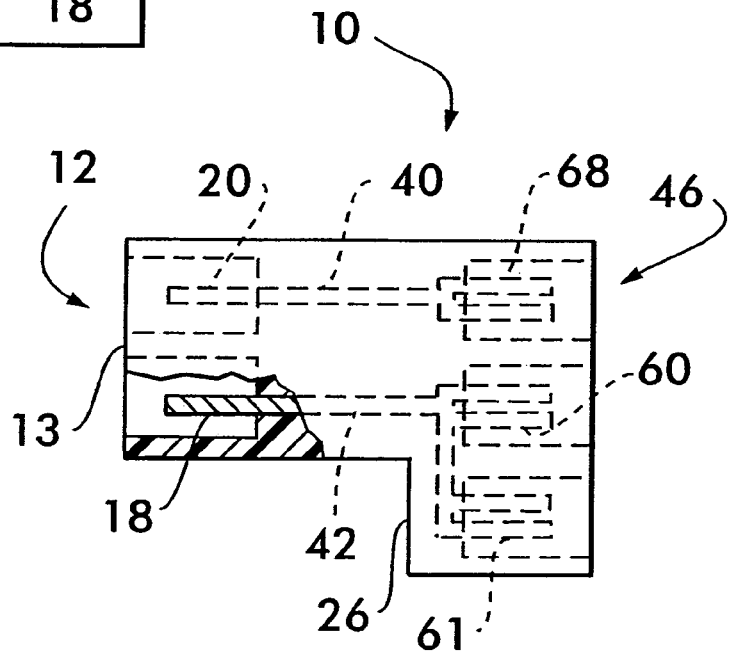
FIG. 3 and FIG. 4 are side and rear views, respectively, of the wiring junction block of FIG. 2.
Figure 4:
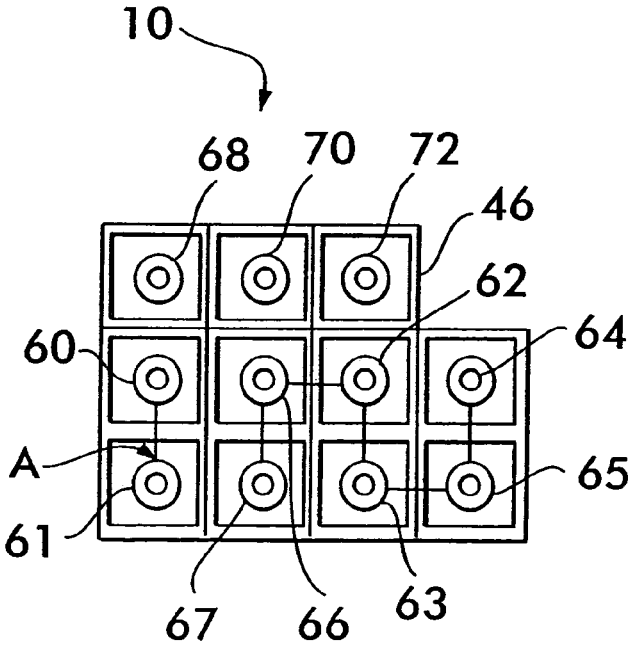

Referring to FIGS. 2–4, there are seen front, side, and rear views, respectively, of an embodiment of the wiring junction block 10 of the present invention. The input end 12 of the junction block 10 includes six input terminals 14, 16, 18, 20, 22, 24 that are designed to connect to a conventional vehicle wiring harness (not shown) via a mating connector (not shown). As an example of the types of signals that may be transmitted by these terminals, although other variations are possible, input terminal 14 receives a ground signal, input terminal 16 receives a stop lamp signal, input terminal 18 receives a tail lamp signal, input terminal 20 receives a turn lamp signal (either right turn or left turn), input terminal 22 receives a backup lamp signal, and input terminal 24 receives a fog lamp signal. It is emphasized that these particular signals are intended to serve only as examples of the types of signals that may be transmitted via the junction block 10. A greater or fewer number of signals could be provided for. As shown in the figures, the wiring junction block 10 includes a recessed surface 26 that is set back from a front surface 13 of input end 12; however, the junction block could be designed to have a single, flush surface extending across its entire front side.

The side view of FIG. 3 shows internal electrical conductors 40 and 42 of junction block 10. Conductor 40 is both connected to input terminal 20 at the input end 12 and to an output terminal 68, as discussed below, at an output end 46. In this particular embodiment, conductor 40 transmits a turn lamp signal from input terminal 20 to its respective output terminal 68, which in turn connects to another mating connector (not shown) that sends the turn lamp signal to the appropriate lamp. Similarly, conductor 42 is connected to input terminal 18 at input end 12. However, conductor 42 splits into two separate paths such that the single input terminal 18 feeds two separate output terminals 60, 61 at the output end 46. Conductor 42 therefore accommodates one input terminal and two output terminals. As previously noted, input terminal 18 receives a tail lamp signal and this branching of conductor 42 to the two output terminals 60, 61 enables that signal to be routed to two separate lamps in the rear lighting assembly without the need for splicing of wiring.

Turning now to FIG. 4, the common connection (electrical shorting) of these two output terminals 60, 61 is represented diagrammatically by the wire connection shown in that figure at A. Similarly, the stop lamp signal provided to input terminal 16 is connected internally within the junction block 10 to two output terminals 66, 67 so that the signal can be routed to two separate lamps. Ground terminal 14 is connected within the junction block 10 to four output terminals 62, 63, 64, 65, as shown, and this permits the junction block to be used with up to four different lamps to implement the stop, turn, tail, backup, and fog lamp functions that can be signaled via the input terminals 16, 18, 20, 22, 24. The remaining output terminals 68, 70, 72 are each connected individually to the input terminals 20, 22, 24, respectively, by separate isolated conductors, such as conductor 40 shown in FIG. 3. Junction block 10 thus has six input terminals (see FIG. 2) and eleven output terminals (see FIG. 4). As previously stated, the particular signals being transmitted, the number of input terminals, the number of output terminals, etc., can differ from the particular exemplary embodiment shown, as desired. This embodiment has been provided to illustrate that at least one internal conductor may branch into multiple channels, while another may remain a single channel as they extend through the junction block 10.

The junction block 10 is formed from a plastic body 30 housing the electrical terminals 14, 16, 18, 20, 22, 24 and 60, 62, 63, 64, 65, 66, 67, 68, 70, 72. For example, the junction block body 30 can be a single unitary plastic component injection molded about the terminals and internal conductors. Alternatively, the junction block 10 can comprise a collection of separate pieces assembled together.

As shown, the input terminals can be metal blade terminals that mate with suitable socket or clip terminals from a wiring harness connector. The output terminals can be socket terminals that receive correspondingly shaped plug terminals from a lamp wiring harness connector that is used to connect to the various lamps in the rear lighting assembly. Of course, terminals having other shapes or of other connecting configurations can be used. Furthermore, the terminals at either the input end 12, or output end 46, or both, can be hardwired to the vehicle and lamp wiring harnesses.

In order to increase the versatility of the junction block, that is, in order to make the junction block compatible with a wide variety of wiring harness connectors and vehicle applications, the junction block 10 can include input and output terminals for each of the potential signals required for the different applications. Thereafter, for any particular application, any unneeded input and output terminals can be simply left unused, or be sealed off with molded plugs. For example, the fog lamp signal terminals 24 and 72 can be provided to accommodate European platforms even though no rear fog lamp is normally used in the United States. Then, for the U.S. platforms, these terminals are simply left unused. Thus, the junction block 10 provides a single common (universal) junction block that may be utilized in a variety of vehicle platforms.

Figure 5:
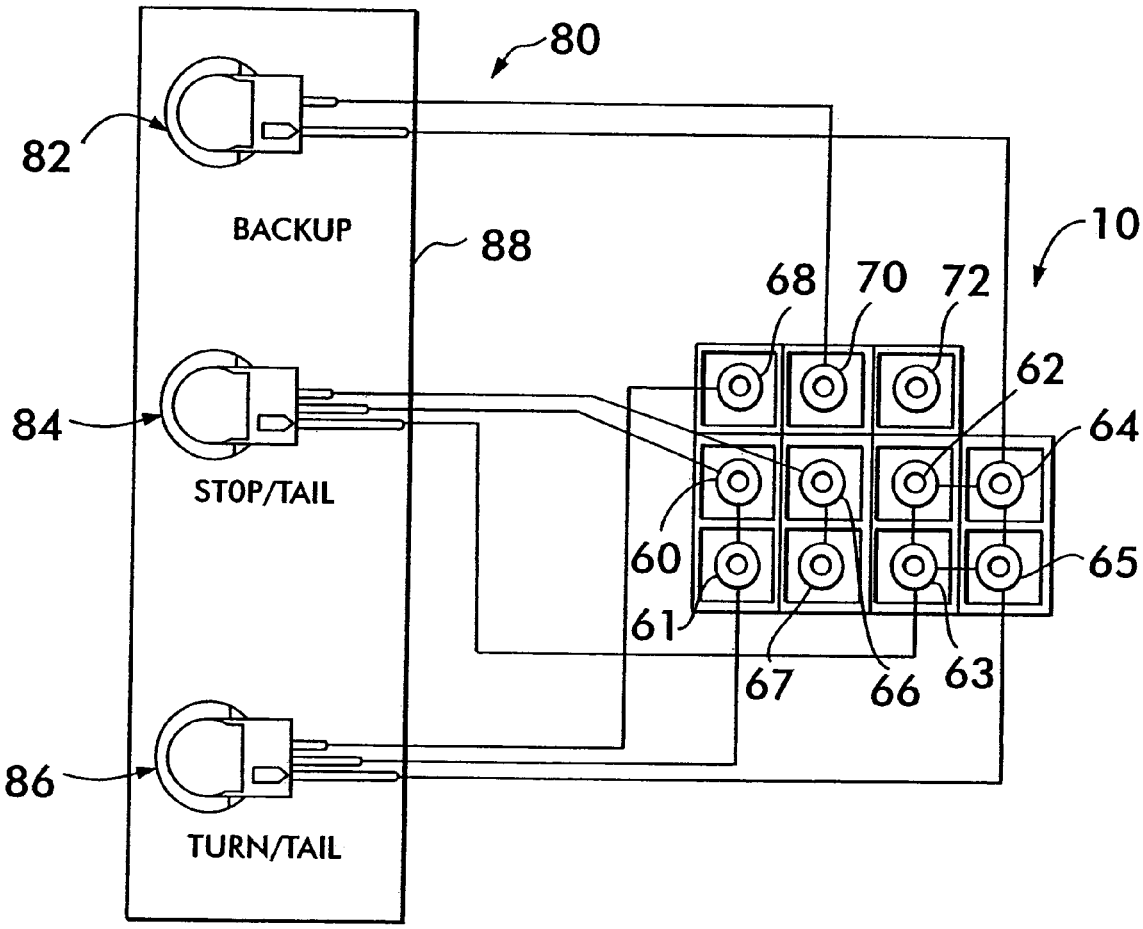
FIG. 5 is a wiring diagram for a vehicle lighting assembly showing use of the wiring junction block of FIG. 2.

Referring now to FIG. 5, the output end 46 of the junction block 10 of FIGS. 2–4 is shown. The rear lighting assembly 80 is an example of the type of lighting assembly that may be used with the junction block 10. This particular lighting assembly includes three lighting devices—a backup lamp 82, a stop/tail lamp 84, and a turn/tail lamp 86—and these lighting devices are shown from their rear side wherein only the integrated socket/connectors are shown mounted in a conventional manner to a common vehicle panel 88. These sockets each support a standard incandescent lamp (not shown) such as a GT-8 model available from the Wagner Lighting division of Federal-Mogul Corporation. A socket design such as that shown in U.S. Pat. No. 5,035,643 to Forish et al. can be used, and the complete disclosure of that patent is hereby incorporated by reference. Suitable sockets are available from the Zanxx division of Federal-Mogul Corporation.

According to this particular embodiment, backup lamp 82 includes a single filament that is connected to output terminal 70 for receiving a backup lamp signal and to output terminal 64 for receiving a ground signal connection. Stop/tail lamp 84 includes two filaments. The first, or major, filament is connected to output terminal 66 such that it receives the stop lamp signal. The second, or minor, filament is connected to output terminal 60 such that it receives a tail lamp signal. Lamp 84 uses a single ground wire to connect with output terminal 63, such that a ground connection is provided for both filaments.

Turn/tail lamp 86 also includes two filaments, one of which is a first, or major, filament connected to output terminal 68 for receiving a turn lamp signal. A second, or minor, filament is connected to the other tail lamp output terminal 61. As with the other lamps, the turn/tail lamp 86 has a ground wire, which is connected to output terminal 65.

As indicated in FIG. 4, several of the junction block output terminals are not connected to a lighting device. Output terminal 72, which carries the fog lamp signal, output terminal 62 which is one of the four output terminals connected to ground, and output terminal 67, which carries the stop lamp signal, are all unused by this exemplary rear lighting assembly. Thus, these output terminals can be sealed off with a molded plug. If this particular application required any of these unused terminals/signals, they would simply be connected to the appropriate lighting device. In this manner, the junction block of the present invention can accommodate a wide variety of applications potentially having various input and output terminal configurations.

With reference now to FIG. 6, there is shown an embodiment in which a junction block 100 includes an integral mounting feature so that the junction block 100 can be mounted in an aperture 102 of a panel or other vehicle support structure 104. The junction block 100 thereby provides the dual function of splicing common connections (such as the tail lamp and ground connections) and acting as a feed-through of the electrical power through a body panel. Junction block 100 includes an input end 106 that mates with a complementary connector 108, which can be provided as a part of the vehicle wiring harness.

The junction block 100 also includes an output end 110 that, in this embodiment, is hardwired to individual sockets for the various lamps in the lighting assembly. The particular mounting feature shown in FIG. 6 is a twist-lock connector 112 that includes locking lugs 114 such that the twist-lock connector 112 can be inserted into the aperture 102 and then be rotated counter-clockwise so that the locking lugs 114 secure the junction block 100 in place on the panel 104, thereby securely fastening the junction block 100 to the panel 104. The locking lugs 114 can either interact with the surface of the panel itself, as shown, or engage complementary mounting features designed into the panel.

An elastomeric O-ring 116 or other suitable perimeter seal can be provided to prevent moisture from passing from one side of the panel to the other. As will be appreciated by those skilled in the art, junction block 100 permits wires to be coupled from the vehicle wiring harness connector 108, through the opening 102 in the panel 104, and into the necessary number of connections for the rear lighting assembly, without the need for feeding wires through the opening and then manually terminating them in a connector. In this embodiment, the wires extending from the output end 110 are hardwired. However, socket or plug terminals could be used to connect to another connector, as in FIGS. 2–5. The other aspects of junction block 100 (e.g., internal connections and plastic body construction) can be the same as described above in connection with FIGS. 2–5.

Figure 8:
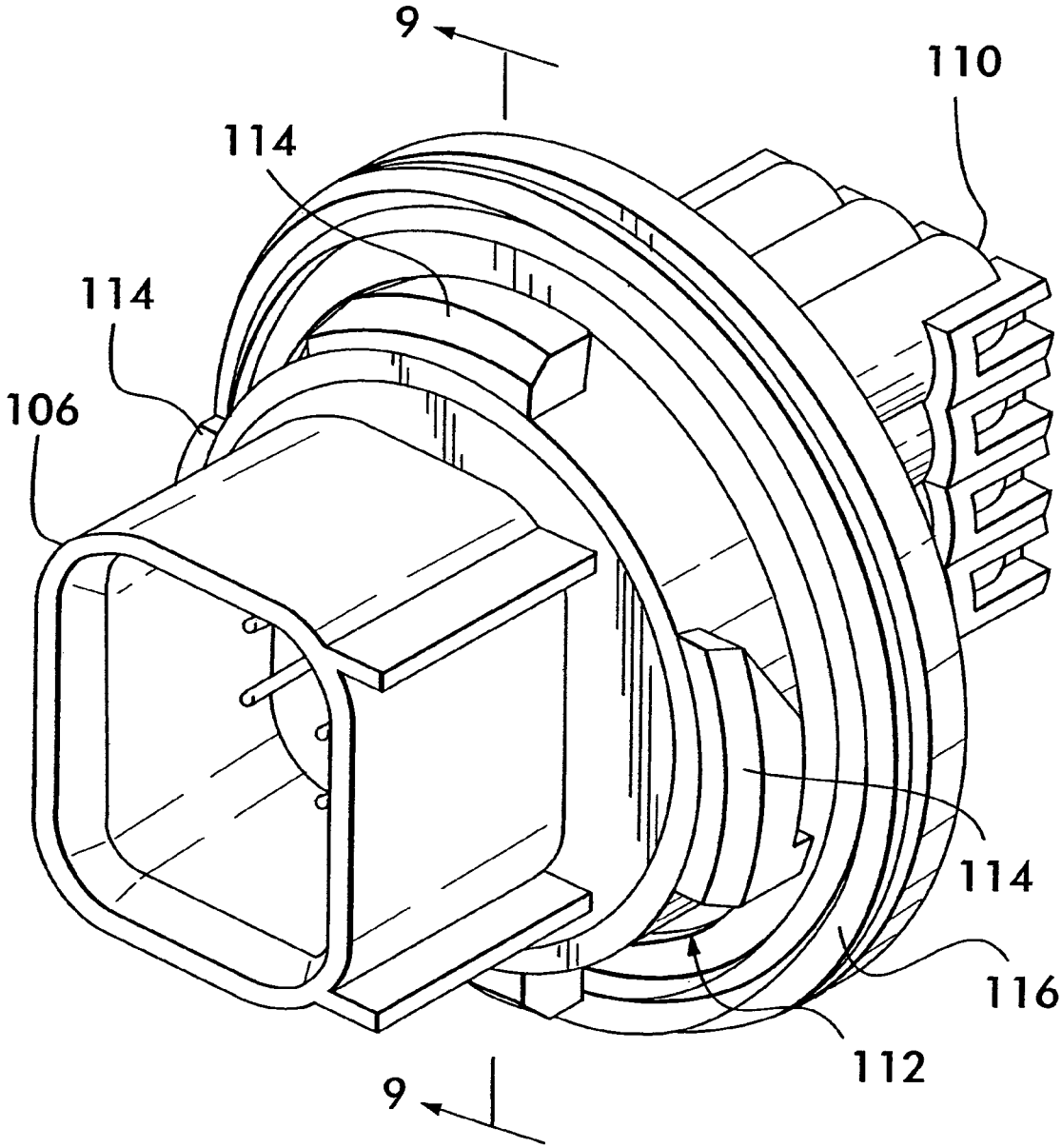
FIG. 8 is a perspective view of yet another alternative embodiment of a wiring junction block in accordance with the present invention.
Figure 9:
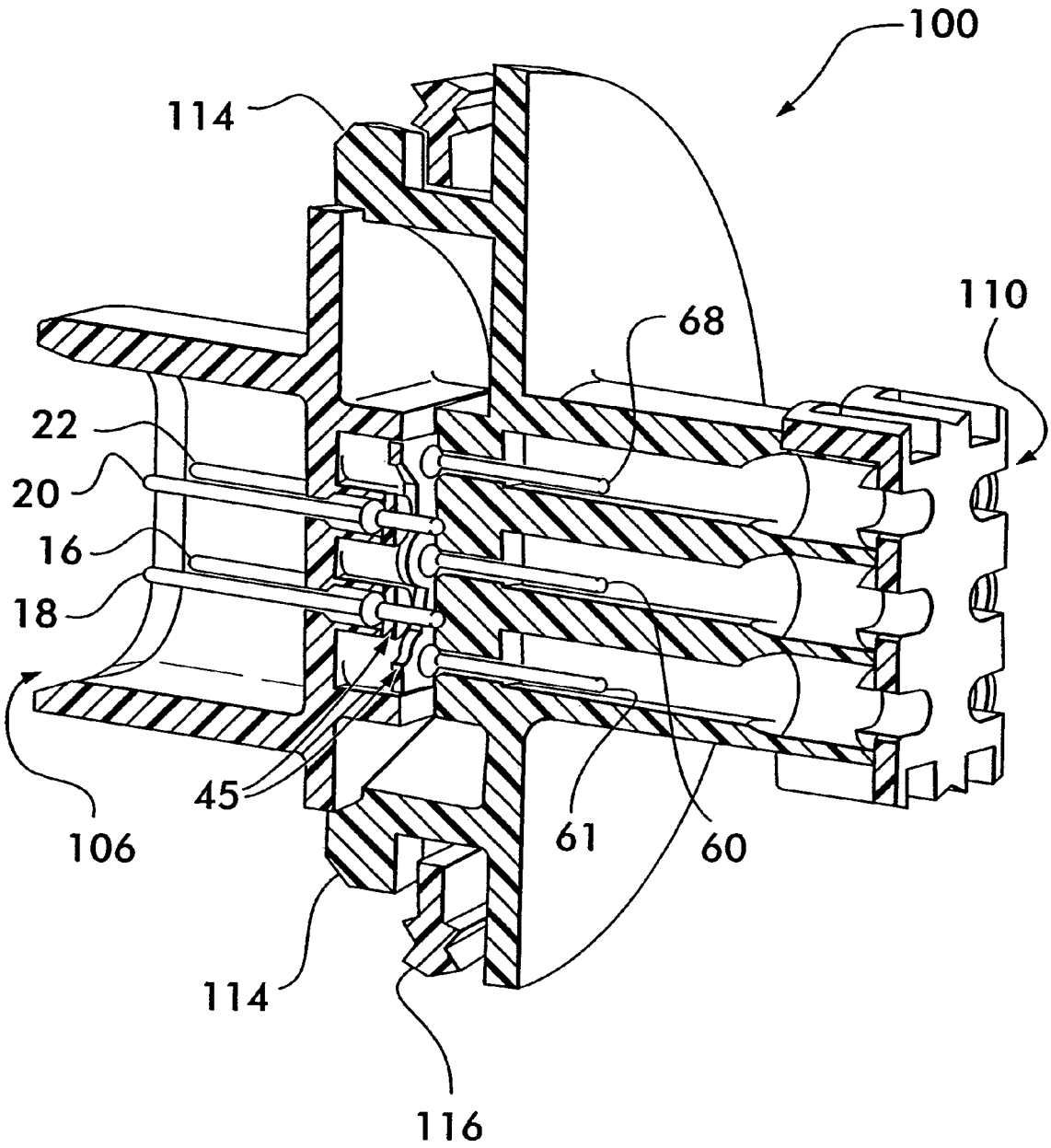
FIG. 9 is a cross-sectional view of the wiring junction block of FIG. 8, taken along line 9—9.

FIGS. 8 and 9 show an alternative embodiment of a junction block 100 in accordance with the present invention. Like the junction block 100 of FIG. 6, the junction block 100 of FIGS. 8 and 9 includes an integral mounting feature, namely twist-lock connector 112 that includes locking lugs 114 such that the twist-lock connector 112 can be inserted into an aperture (not shown) and rotated counter-clockwise so that the locking lugs 114 secure the junction block 100 in place on a panel (not shown), thereby securely fastening the junction block 100 to the panel as discussed above with reference to FIG. 6. Additionally, the junction block 100 includes an elastomeric or other suitable perimeter seal 116 to prevent moisture from passing from one side of the panel to the other. The junction block 100 includes an input end 106 for mating with a complementary connector (not shown), which can be provided as part of a vehicle wiring harness. The junction block 100 also includes an output end 110 that, in this embodiment, is configured to receive a connector from a lighting assembly, etc. Accordingly, the junction block 100 provides a dual function of splicing common connections and acting as a feed-through of electrical power through a body panel as discussed above with reference to FIG. 6.

In the embodiment of FIGS. 8 and 9, however, pin type terminals 16, 18, 20, 22 are provided on the input end 106, as well as on the output end 110 as shown at 60, 61, 68. In the example of FIGS. 8 and 9, the input and output terminals are electrically connected as described above with reference to FIGS. 2–5. However, in this embodiment, electrical circuitry 45 is provided to electrically connect the input and output terminals, as desired. Specifically, in the example of FIGS. 8 and 9, stamped copper traces, or the like, 45 are provided to electrically connect the input and output terminal pins, as desired. Accordingly, the electrical circuitry 45 replaces, or implements, conductors 40, 42, etc. In an alternative embodiment, a conventional-type printed circuit board provides the electrical circuitry to electrically interconnect the input and output terminals. It should be noted that resistors, diodes and other electrical/electronic components may be integrated into the circuitry interconnecting the input and output terminals, as desired. Any suitable circuitry can be provided as will be appreciated by those skilled in the art. In the exemplary embodiment of FIGS. 8 and 9 the junction block 100 is formed from two mechanically joined halves 100*a*, 100*b* with the desired circuitry disposed therebetween. Alternatively, the entire junction block 100 may be formed as a unit around the circuitry and pins using a conventional insert molding technique.

It will thus be apparent that there has been provided in accordance with the present invention an electrical wiring junction block for use with vehicle lighting systems that achieves the aims and advantages specified herein. It will of course be understood that the foregoing description is of preferred exemplary embodiments of the invention and that the invention is not limited to the specific embodiments shown. Various changes and other modifications will become apparent to those skilled in the art. All such variations and modifications are intended to come within the scope of the invention.

What is claimed is:

1. A wiring junction block, comprising:

a first plastic junction block body member, said first plastic junction block body member having an input end including a first set of electrical terminals;

a second plastic junction block body member interconnected to said first plastic junction block body member, said second plastic junction block body member having an output end including a second set of electrical terminals, said second set of terminals including at least one group of two or more terminals that are electrically shorted to each other;

the number of terminals in said first set being less than the number of terminals in said second set;

circuitry electrically connecting at least one of said first set of electrical terminals to at least one of said second set of electrical terminals, said circuitry enclosed between said first and second junction block body members, said circuitry comprising stamped trace circuits including at least one resistor component;

a mounting feature located on at least one of said first and second junction block body members and adapted to enable mounting to an aperture in a vehicle support structure, said mounting feature comprising at least one locking lug adapted to removably mount the body within the aperture; and a perimeter seal positioned adjacent said mounting feature for preventing moisture from passing from one side of the vehicle support structure to another.

* * * * *